US011473739B2

(12) United States Patent
He

(10) Patent No.: US 11,473,739 B2
(45) Date of Patent: Oct. 18, 2022

(54) LIGHT STRING AND DECORATIVE ILLUMINATION ASSEMBLY

(71) Applicant: SHANGYOU JIAYI LIGHTING PRODUCT CO., LTD., Ganzhou (CN)

(72) Inventor: Yaowen He, Ganzhou (CN)

(73) Assignee: SHANGYOU JIAYI LIGHTING PRODUCT CO., LTD., Ganzhou (CN)

( * ) Notice: Subject to any disclaimer, the term of this patent is extended or adjusted under 35 U.S.C. 154(b) by 0 days.

(21) Appl. No.: 17/670,986

(22) Filed: Feb. 14, 2022

(65) Prior Publication Data

US 2022/0170599 A1 Jun. 2, 2022

Related U.S. Application Data

(63) Continuation of application No. PCT/CN2020/137386, filed on Dec. 17, 2020.

(30) Foreign Application Priority Data

Oct. 17, 2019 (CN) ..... 201921748608.7

(51) Int. Cl.
*F21S 4/10* (2016.01)
*F21Y 115/10* (2016.01)

(52) U.S. Cl.
CPC ..... *F21S 4/10* (2016.01); *F21Y 2115/10* (2016.08)

(58) Field of Classification Search
CPC . F21Y 2115/10; F21S 4/10; F21S 4/20; F21V 23/001; F21V 23/002; F21W 2121/04
See application file for complete search history.

(56) References Cited

U.S. PATENT DOCUMENTS 8,072,152 B2 * 12/2011 Neuman ..... H05B 45/30 315/185 S
10,288,235 B1 * 5/2019 Chen ..... F21V 23/002
10,288,236 B1 * 5/2019 Chen ..... F21V 19/0025
2004/0115984 A1 6/2004 Rudy et al.
(Continued)

FOREIGN PATENT DOCUMENTS

CN 101493198 A 7/2009
CN 201373298 Y 12/2009
(Continued)

OTHER PUBLICATIONS

Notification to Grant Patent Right for Invention of Priority Document 201921748608.7, dated May 9, 2020.
(Continued)

*Primary Examiner* — Peggy A Neils
(74) *Attorney, Agent, or Firm* — Hogan Lovells US LLP

(57) ABSTRACT

A light string and a decorative illumination assembly are provided. The light string includes a first wire, a second wire, a third wire, and a plurality of light emitting devices, the plurality of light emitting devices being linked sequentially by the third wire. The first wire, the second wire, and the third wire are arranged in parallel, and the first wire and the second wire are separately affixed to the third wire. The second wire is connected to a positive electrode of a power supply, negative electrodes of the light emitting devices are connected to the first wire, and positive electrodes of the light emitting devices are connected to the second wire.

19 Claims, 4 Drawing Sheets

(56) References Cited

U.S. PATENT DOCUMENTS

| | | | | |
|---|---|---|---|---|
| 2018/0172226 | A1* | 6/2018 | Zhao | G06F 3/04847 |
| 2019/0376669 | A1* | 12/2019 | Shao | F21S 4/26 |

FOREIGN PATENT DOCUMENTS

| | | | |
|---|---|---|---|
| CN | 101825243 | A | 9/2010 |
| CN | 204901448 | U | 12/2015 |
| CN | 110542028 | A | 12/2019 |
| CN | 211083697 | U | 7/2020 |
| WO | 2018/027454 | A1 | 2/2018 |

OTHER PUBLICATIONS

International Search Report and Written Opinion issued in PCT Application No. PCT/CN2020/137386, dated Mar. 16, 2021 with English Translation.

* cited by examiner

Prior art

LIGHT STRING AND DECORATIVE ILLUMINATION ASSEMBLY

CROSS-REFERENCE TO RELATED APPLICATION

This application is a bypass continuation application of PCT/CN2020/137386 filed on Dec. 17, 2020, which claims priority to Chinese patent application with the filing number CN201921748608.7 filed on Oct. 17, 2019 with the Chinese Patent Office, and entitled "LIGHT STRING AND DECORATIVE ILLUMINATION ASSEMBLY", the contents of which are incorporated herein by reference in their entireties.

TECHNICAL FIELD

The present disclosure relates to the technical field of light fixtures, in particular to a light string and a decorative illumination assembly.

BACKGROUND ART

The light string in the prior art is usually in four-wire structure as shown in FIG. 1, wherein two wires 91 and 92 are the main wires, which are connected to a negative electrode of a power supply and a positive electrode of the power supply respectively, and the other two wires 93 and 94 are the light string wires, which are configured to connect in series with multiple light emitting units 90 successively, and each light emitting unit 90 may comprise multiple light emitting devices 901 (such as LED lamps) connected in parallel. The multiple light emitting units are connected in series in the following way.

The wires 93 and 94 are provided in parallel, and both of them have opposite first end and second end, wherein the first end of the wire 93 is connected to the wire 91 and the second end of the wire 94 is connected to the wire 92. Negative electrode of each light emitting unit 90 is connected to the wire 93, and positive electrode thereof is connected to the wire 94, the wires 93 and 94 are disconnected at the positions corresponding to the intervals between every two adjacent light emitting units 90, and the wire 94 connected to the positive electrode of the previous light emitting unit 90 and the wire 93 connected to the negative electrode of the latter light emitting unit 90 are welded to each other, which forms a welding point, the welding point A as shown in FIG. 1.

The welding point of the two light emitting units 90 is prone to false welding and/or poor contact or the like, and the wires 91 and 92 are scattered, which usually need to be wound together with the light string wires 93 and 94, wherein the winding process easily causes loose weld of the two adjacent light emitting units 90 at the welding point.

SUMMARY

In order to at least overcome the above-mentioned shortcomings in the prior art, one of the objectives of the present disclosure is to provide a light string and a decorative lighting assembly.

In a first aspect, an embodiment of the present disclosure provides a light string, comprising: a first wire, a second wire, a third wire, and a plurality of light emitting devices, wherein the plurality of light emitting devices are successively connected in series via the third wire;

the first wire, the second wire, and the third wire are provided in parallel with each other, and the first wire and the second wire are respectively fixed to the third wire;

the first wire is connected to a negative electrode of a power supply, and the second wire is connected to a positive electrode of the power supply; and negative electrodes of the light emitting devices are connected to the first wire, and positive electrodes of the light emitting devices are connected to the second wire.

In an optional embodiment, the first wire comprises a first wire core and a first insulating layer that wraps the first wire core, the second wire comprises a second wire core and a second insulating layer that wraps the second wire core, and a third wire comprises a third wire core and a third insulating layer that wraps the third wire core;

the first insulating layer and the second insulating layer are respectively fixed to the third insulating layer; and the plurality of light emitting devices are successively connected in series through the third wire core, and the third insulating layer is provided with openings each corresponding to a respective light emitting device to expose the light emitting device.

In an optional embodiment, the first insulating layer, the second insulating layer, and the third insulating layer are each a transparent insulating layer.

In an optional embodiment, the first insulating layer, the second insulating layer, and the third insulating layer are each a colored insulating layer, for example, a green insulating layer or a white insulating layer.

In an optional embodiment, the first wire, the second wire, and the third wire are in an integrated three-parallel-wire structure.

In an optional embodiment, the first wire, the second wire and the third wire are three independent wires.

In an optional embodiment, the third wire is divided into multiple sections of sub-wires, and each section of sub-wire is successively connected in series with more than one light emitting device, wherein one end of the section of the sub-wire is connected to the first wire through a first resistor, and the other end thereof is connected to the second wire through a second resistor.

In an optional embodiment, the first light emitting device connected in series with each section of sub-wire and the first resistor connected with the section of sub-wire are wrapped by the first material, and the last light emitting device connected in series with each section of sub-wire and the second resistor connected with the section of sub-wire are wrapped by the second material, wherein the first material and the second material are any one of a transparent material, a translucent material, and a mist-like material.

In an optional embodiment, the first material and the second material are both light diffusion glue.

In an optional embodiment, the light emitting device is an LED lamp provided thereinside with an integrated circuit chip.

In an optional embodiment, the third wire is electrically connected to a controller, and is configured to transmit the input control signal provided by the controller to the integrated circuit chip in each LED lamp.

In the second aspect, the embodiment of the present disclosure provides a decorative lighting assembly, comprising a main body and at least one light string as described in any one of the foregoing embodiments, and the at least one light string is provided on the main body.

Compared with the prior art, the embodiments of the present disclosure have the following beneficial effects:

an embodiment of the present disclosure provides a light string and a decorative illumination assembly, the light string includes a first wire, a second wire, a third wire, and a plurality of light emitting devices, and the multiple light emitting devices are successively connected in series through the third wire. The first wire, the second wire and the third wire are provided in parallel with each other, wherein the first wire and the second wire are respectively fixed to the third wire. The first wire is connected with a negative electrode of the power supply, the second wire is connected with a positive electrode of the power supply, negative electrodes of the light emitting devices are connected with the first wire, and positive electrodes of the light emitting devices are connected with the second wire. Thus, it can avoid winding of the scattered first wire and second wire on the third wire that serves as a light string wire, thus preventing light emitting devices from loose weld.

In addition, since it is unnecessary to wind the first wire and the second wire with the third wire, the light shading area of the first wire and the second wire to the light emitting devices is reduced, which improves the light emitting effect of the light string.

In order to make the above-mentioned objectives, features and advantages of the present disclosure more obvious and understandable, preferred embodiments accompanied with accompanying drawings are described in detail as follows.

BRIEF DESCRIPTION OF DRAWINGS

In order to illustrate the technical solutions of the embodiments of the present disclosure more clearly, the drawings need to be used in the embodiments will be briefly introduced below, it should be understood that the following drawings only show some embodiments of the present disclosure, and therefore should not be regarded as a limitation of the scope, and for those ordinarily skilled in the art, other relevant drawings can also be obtained in light of these drawings, without using any inventive efforts.

Figure 1:
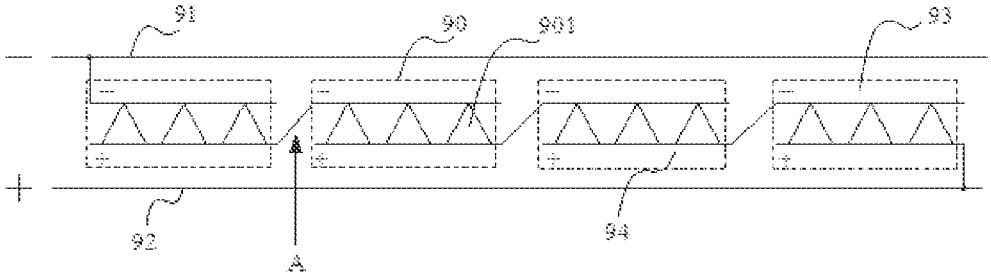
FIG. 1 is a structural schematic view of a light string in the prior art.

Reference signs: 100, 400—light string; 110, 410—first wire; 111—first wire core; 112—first insulating layer; 120, 420—second wire; 121—second wire core; 122—second insulating layer; 130, 430—third wire; 131—third wire core; 132—third insulating layer; 1321, 1322—opening; 140 (140A, 140B, 140C, 140D, 140E, 140F, 140G), 91—light emitting device; 440 (440A, 440B)—LED lamp; 441—first terminal; 442—second terminal; 443—signal input terminal; 444—signal output terminal; 90—light emitting unit; 201—first resistor; 202—second resistor; 500—controller.

DETAILED DESCRIPTION OF EMBODIMENTS

In order to make the objectives, technical solutions and advantages of the embodiments of the present disclosure clearer, the technical solutions in the embodiments of the present disclosure will be described clearly and completely below in conjunction with drawings in the embodiments of the present disclosure. Obviously, the described embodiments are a part of the embodiments of the present disclosure, rather than all of the embodiments. The components of embodiments of the present disclosure generally described and illustrated in the drawings herein may be arranged and designed in a variety of different configurations.

Therefore, the following detailed description of the embodiments of the present disclosure provided in the accompanying drawings is not intended to limit the claimed scope of the present disclosure, but merely represents selected embodiments of the present disclosure. Based on the embodiments of the present disclosure, all other embodiments, obtained by those ordinarily skilled in the art without making inventive effort, fall within the protection scope of the present disclosure.

It should be noted that similar reference numerals and letters indicate similar items in the following drawings, therefore, once a certain item is defined in one drawing, it does not need to be further defined and explained in the subsequent drawings.

Figure 2:
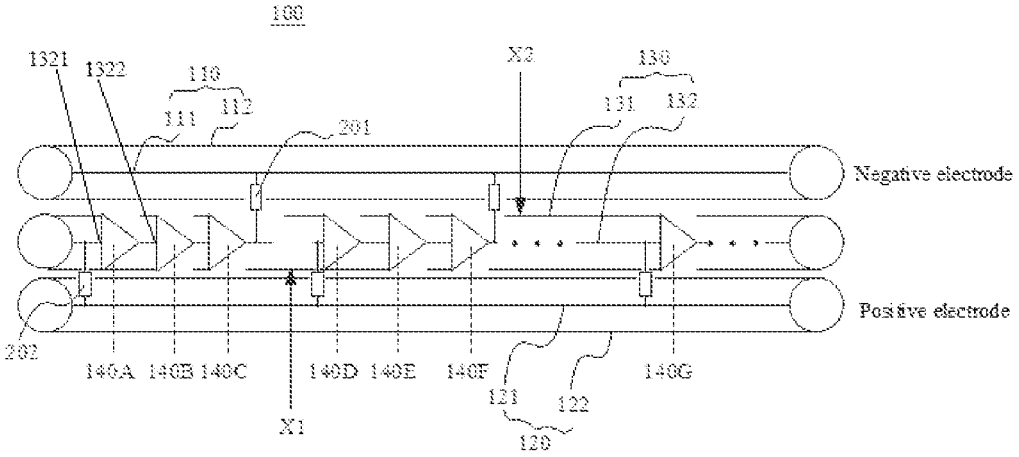
FIG. 2 is a structural schematic view of a light string provided by an embodiment of the present disclosure.

Please refer to FIG. 2, FIG. 2 is a structural schematic view of a light string 100 provided by an embodiment of the present disclosure.

The light string 100 includes a first wire 110, a second wire 120, a third wire 130, and a plurality of light emitting devices 140, the plurality of light emitting devices 140 may be, for example, 7 light emitting devices 140A to 140G shown in FIG. 2.

In the above, the first wire 110 is connected to a negative electrode of a power supply, the second wire 120 is connected to a positive electrode of the power supply, the plurality of light emitting devices 140 are connected in series via the third wire 130 successively, and positive electrode of each of the light emitting devices 140 is directly or indirectly connected to the second wire 120, the negative electrode of each of the light emitting devices 140 is directly or indirectly connected to the first wire 110.

In the present embodiment, the first wire 110, the second wire 120, and the third wire 130 are provided in parallel and are substantially located on a plane. In the above, the third wire 130 is provided between the first wire 110 and the second wire 120, and the first wire 110 and the second wire 120 are respectively fixed to the third wire 130.

Thus, through the first wire, the second wire, and the third wire that are fixed to each other, the first wire and the second wire can be prevented from being wound with the third wire configured to connect the light emitting devices in series, thereby avoiding that the light emitting devices on the third wire are pulled during the winding process, which causes loose weld of the light emitting devices that are false welded and thus occurrence of situation that the light emitting devices cannot work.

Further, if the first wire and the second wire are wound around the third wire, they inevitably may cover part of the light emitting devices on the third wire, which affects the light emitting effect of the part of the light emitting devices, but this problem can be avoided in the light string provided by the present embodiment.

Figure 3:
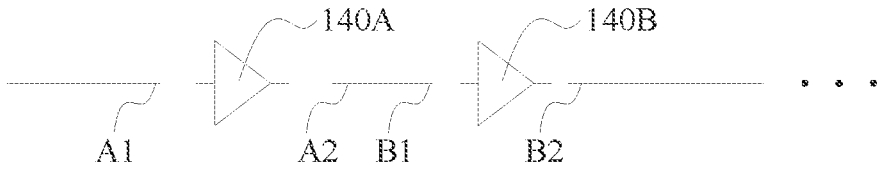
FIG. 3 is a schematic view of series connection of light emitting devices provided by an embodiment of the present disclosure.

Referring to FIG. 3, the light emitting devices 140A and 140B shown in FIG. 3 are taken as an example to describe the series connection manner of multiple light emitting devices 140 in the present embodiment below.

During implementation, a cutting operation can be performed at one position of the third wire 130, and after the cutting operation, two end parts, for example, A1 and A2 respectively, may be formed on the third wire 130. Taking the light emitting device 140A as an example, the positive electrode of the light emitting device 140A can be connected to the end part A1, and the negative electrode of the light emitting device 140A can be connected to the end part A2.

Similarly, a cutting operation can be performed at another position of the third wire 130 to form two new end parts, B1 and B2, respectively. Taking the light emitting device 140B as an example, the positive electrode of the light emitting device 140B may be connected to the end part B1, and the negative electrode of the light emitting device 140B may be connected to the end part B2. By analogy, the series connection of the individual light emitting devices 140 shown in FIG. 2 can be realized.

Please refer to FIG. 2 again, in the present embodiment, the first wire 110 may include a first wire core 111 and a first insulating layer 112, and the first insulating layer 112 is wrapped around the outside of the first wire core 111. The second wire 120 may include a second wire core 121 and a second insulating layer 122, and the second insulating layer 122 is wrapped around the outside of the second wire core 121. The third wire 130 may include a third wire core 131 and a third insulating layer 132, and the third insulating layer 132 is wrapped around the outside of the third wire core 131.

In the above, the multiple light emitting devices 140 successively connected in series via the third wire 130 are actually successively connected in series via the third wire core 131.

Correspondingly, the third insulating layer 132 of the third wire 130 is provided with openings each corresponding to the respective light emitting device 140 to expose the light emitting device. For example, as shown in FIG. 2, the third insulating layer 132 is provided with an opening 1321 corresponding to the light emitting device 140A, and an opening 1322 corresponding to the light emitting device 140B, and the like.

In some embodiments, the first insulating layer 112, the second insulating layer 122, and the third insulating layer 132 may be each a colored insulating layer, e.g., a green insulating layer or a white insulating layer.

In other embodiments, in order to further reduce the light shading effect of the first wire 110 and the second wire 120 on the light emitting devices 140 on the third wire 130, the first insulating layer 112, the second insulating layer 122, and the third insulating layer 132 may be each a transparent insulating layer.

It is worth noting that, in the prior art, since multiple wires are wound with each other, once the insulating layer of the wire falls off with use, a short circuit phenomenon may occur. However, in the present embodiment, the first wire 110 and the second wire 120 are separated by the third wire 130, which reduces the risk of short circuit.

In the present embodiment, the first wire 110, the second wire 120, and the third wire 130 may be fixed with each other in a variety of ways.

In one embodiment, three independent wires may be used as the first wire 110, the second wire 120, and the third wire 130 respectively, and then the first wire 110 and the second wire 120 are respectively fixed to the third wire 130.

In another embodiment, the first wire 110, the second wire 120, and the third wire 130 may be provided integrally to form a three-parallel-wire structure. In the three-parallel-wire structure, a wire in the middle is used as the third wire 130, and after it is cut at a specific position thereof, the light emitting device is welded to the cut position, wherein since the three wires in the three-parallel-wire structure are relatively fixed, it is easy to be welded.

In this embodiment, the light emitting devices 140 may be implemented in a variety of ways. In one embodiment, the light emitting devices 140 may be LED (Light Emitting Diode) lamps.

Please refer to FIG. 1 again, a designed light string using LED lamps, the number of light emitting units 90 included thereof and the number of light emitting devices 91 included in each light emitting unit 90 are determined, in other words, the length of the light string is fixed and cannot be arbitrarily cut to adapt to different use lengths, for example, cutting at the welding point A may cause the multiple light emitting units 90 to fail to work.

In order to at least partially improve the above-mentioned problems, in the embodiments of the present disclosure, the third wire 130 may be divided into multiple sections of sub-wires, and each section of sub-wire is successively connected in series with more than one light emitting device 140, and one end of the section of sub-wire is connected to the first wire 110 through the first resistor 201, that is, to the negative electrode of the power supply; the other end of the section of sub-wire is connected to the second wire 120 through the second resistor 202, that is, to the positive electrode of the power supply.

In this way, the more than one light emitting device 140 connected in series with each section of sub-wire constitutes the smallest unit of the light string 100. In practical applications, a specific multiple of the smallest unit can be selected according to the requirements for arbitrary cutting, which makes the design more flexible.

It is worth noting that the defects in the above schemes are all the results obtained by practice and careful study. Therefore, the discovery process of the above-mentioned problems and the technical solutions proposed by the present embodiment to the above-mentioned problems should be regarded as contributions to the present disclosure.

Exemplarily, please refer to FIG. 2 again, three light emitting devices 140 are connected in series on each section of the sub-wire. In this way, it can be arbitrarily cut in units of 3 multiples of the light emitting devices 140 according to the requirements. For example, it can be cut from the X1 and/or X2 and other positions shown in FIG. 2.

In practical applications, the light string 100 exists as an ornament, and the exposed first resistor 201 and the second resistor 202 may affect its effect as an ornament.

In the present embodiment, the first material is used to wrap the first light emitting device 140 connected in series with each section of sub-wire and the first resistor 201 connected to the section of sub-wire, the second material is used to wrap the last light emitting device 140 connected in series to each section of sub-wire and the second resistor 202 connected to the section of sub-wire. In the above, the first material may be any one of a transparent material, a translucent material, and a mist-like material, the second material may be any one of a transparent material, a translucent material, and a mist-like material, and the first material and the second material may be the same or different.

Through the above design, the first resistor 201 and the second resistor 202 are respectively wrapped in a luminous body. In this way, the influence of the first resistor 201 and the second resistor 202 on the decoration effect of the light string 100 can be avoided.

Exemplarily, the first material and the second material may be, for example, both light diffusion glue.

In other embodiments, the light emitting device 140 may also be an LED lamp with an integrated circuit (IC) chip provided thereinside.

Figure 4:
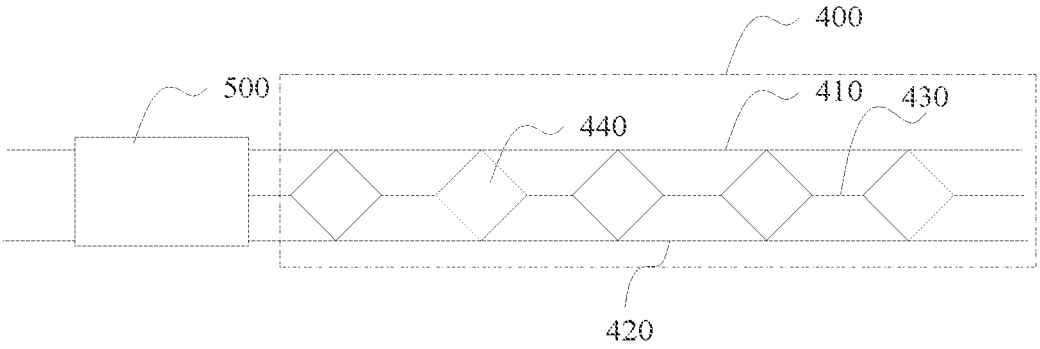
FIG. 4 is a structural schematic view of another light string provided by an embodiment of the present disclosure.

Please refer to FIG. 4, which shows a schematic view of another light string 400 provided by an embodiment of the present disclosure, the light string 400 includes a first wire 410, a second wire 420, a third wire 430, and a plurality of LED lamps 440 with built-in IC chips. The first wire 410 and the second wire 420 are respectively fixed to the third wire 430.

The LED lamp 440 is generally rectangular and has four terminals, which are a first terminal 441, a second terminal 442, a signal input terminal 443, and a signal output terminal 444, respectively. The first terminal 441 is configured to be connected to the negative electrode of the power supply, the second terminal 442 is configured to be connected to the positive electrode of the power supply, the signal input terminal 443 is configured to receive a control signal from the controller, and the signal output terminal 444 is configured to send the received control signal to the next LED lamp 440 connected.

Figure 5:
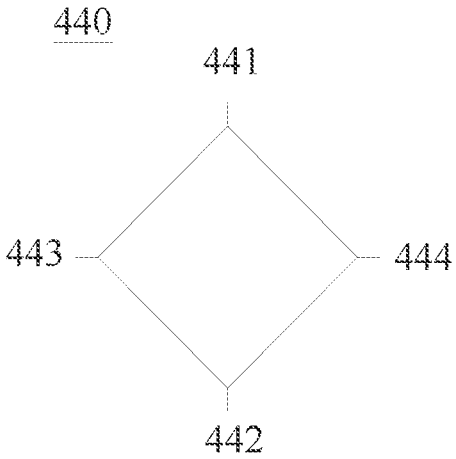
FIG. 5 is a schematic view of distribution of connection terminals of LED lamps of the light string shown in FIG. 4.

Depending on the different sizes of the LED lamps 440, the four terminals are distributed in different positions. For example, in the LED lamp 440 of 5050 (that is, the size of 50 mm×50 mm) shown in FIG. 5, the four terminals are respectively distributed at the four vertices. For another example, when the size is 40 mm×50 mm, the four terminals may be respectively distributed at the midpoints of the four sides.

The first wire 410 is connected to the negative electrode of the power supply, and the first terminal 441 of each LED lamp 440 is connected to the first wire 410. The second wire 420 is connected to the positive electrode of the power supply, and the second terminal 442 of each LED lamp 440 is connected to the second wire 420.

One end of the third wire 430 is connected with a controller 500, and the controller 500 has a built-in program used to control multiple LED lamps 440 on the light string 400. In addition, the third wire 430 is successively connected in series with a plurality of LED lamps 440.

Figure 6:
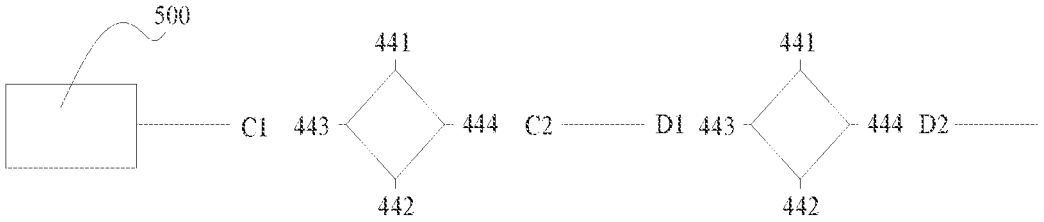
FIG. 6 is a schematic view of series connection of LED lamps of the light string shown in FIG. 4.

Exemplarily, please refer to FIG. 6, taking the series connection of two LED lamps 440A and 440B as an example, the third wire 430 can be cut at a position thereof to form two end parts C1 and C2, wherein the end part C1 connected to the controller 500 is connected to the signal input terminal 443 of the LED lamp 440A, and the other end part C2 is connected to the signal output terminal 444 of the LED lamp 440A. On the third wire 430, it can be cut at a position on one side of the LED lamp 440A away from the controller 500 to form two end parts D1 and D2. The end part D1 connected to the LED lamp 440A is connected to the signal input terminal 443 of the LED lamp 440B, and the other end part D2 is connected to the signal output terminal 444 of the LED lamp 4406.

By analogy, other LED lamps 440 can also be connected in series to the LED lamps 440A and 440B.

In the prior art, LED lamps with built-in IC chips usually use flexible circuit boards to achieve connection and control. On the one hand, the flexible circuit boards are opaque and cannot be wound around objects at will, so the light emitting surface can only face outwards; on the other hand, due to material problems, the flexible circuit board usually cannot be too long, usually one meter for each segment, and multiple one-meter flexible circuit boards need to be spliced together to form a longer circuit board, which requires relatively complex processes. In the present embodiment, the above-mentioned problems are avoided by using the first wire, the second wire, and the third wire.

The embodiment of the present disclosure also provides a decorative illumination assembly, the decorative illumination assembly includes a main body and at least one light string provided on the main body, the light string may be the light string 100 shown in FIG. 2 or the light string 400 shown in FIG. 4, the main body may be, for example, a Christmas tree, a wall, or other objects that need to be decorated, which is not limited in the present embodiment.

In summary, an embodiment of the present disclosure provides a light string and a decorative illumination assembly, the light string includes a first wire, a second wire, a third wire, and a plurality of light emitting devices, and the multiple light emitting devices are successively connected in series through the third wire. The first wire, the second wire and the third wire are provided in parallel, wherein the first wire and the second wire are respectively fixed to the third wire. The first wire is connected with the negative electrode of the power supply, the second wire is connected with the positive electrode of the power supply, negative electrodes of the light emitting devices are connected with the first wire, and positive electrodes of the light emitting devices are connected with the second wire. Thus, the scattered first wire and second wire can be avoid from being wound on third wire that serves as a light string wire, thus preventing loose weld of the light emitting devices.

In the description of the present disclosure, it should be noted orientation or positional relations indicated by terms such as "upper", "lower", "inner", and/or "outer" are based on orientation or positional relations as shown in the accompanying drawings, or orientation or position relationship that the utility model product is usually placed in use, merely for facilitating the description of the present disclosure and simplifying the description, rather than indicating or implying that related devices or elements have to be in the specific orientation, or configured and operated in a specific orientation, therefore, they should not be construed as limitations on the present disclosure.

Besides, terms "first", and/or "second" and the like are merely for distinguishing descriptive purpose, but should not be construed as indicating or implying importance in relativity. It should be noted that, in the case of no conflict, the features in the embodiments of the present disclosure can be combined with each other.

The above are only the various embodiments of the present disclosure, but the protection scope of the present disclosure is not limited thereto, any person skilled in the art can easily think of changes or substitutions within the technical scope disclosed in the present disclosure, all should be covered within the protection scope of the present disclosure. Therefore, the protection scope of the present disclosure should be subject to the protection scope of the claims.

What is claimed is:

1. A light string, comprising: a first wire, a second wire, a third wire, and a plurality of light emitting devices, wherein the plurality of light emitting devices are successively connected in series with each other via the third wire;

the first wire, the second wire, and the third wire are provided in parallel with each other, and the first wire and the second wire are respectively fixed to the third wire;

the first wire is connected to a negative electrode of a power supply, and the second wire is connected to a positive electrode of the power supply; and negative electrodes of the light emitting devices are connected to the first wire, and positive electrodes of the light emitting devices are connected to the second wire, wherein the third wire is divided into multiple sections of sub-wires, and each section of the multiple sections of the sub-wires is successively connected in series with more than one of the light emitting devices, wherein at least one section of the sub-wire has one end connected to the first wire through a first resistor, and another end connected to the second wire through a second resistor.

2. The light string according to claim 1, wherein the first wire comprises a first wire core and a first insulating layer that wraps the first wire core, the second wire comprises a second wire core and a second insulating layer that wraps the second wire core, and a third wire comprises a third wire core and a third insulating layer that wraps the third wire core;

the first insulating layer and the second insulating layer are respectively fixed to the third insulating layer; and the plurality of light emitting devices are successively connected in series with each other through the third wire core, and the third insulating layer is provided with openings each corresponding to a respective light emitting device to expose the light emitting device.

3. The light string according to claim 2, wherein the first insulating layer, the second insulating layer, and the third insulating layer are each a transparent insulating layer.

4. The light string according to claim 2, wherein the first insulating layer, the second insulating layer, and the third insulating layer are each a colored insulating layer.

5. The light string according to claim 4, wherein the first wire, the second wire, and the third wire are in an integrated three-parallel-wire structure.

6. The light string according to claim 4, wherein the first wire, the second wire and the third wire are three independent wires.

7. The light string according to claim 1, wherein the first light emitting device connected in series with each section of sub-wire and the first resistor connected with the section of sub-wire are wrapped by a first material, and the last light emitting device connected in series with each section of sub-wire and the second resistor connected with the section of sub-wire are wrapped by a second material, wherein the first material and the second material are any one of a transparent material, a translucent material, and a mist-like material.

8. The light string according to claim 7, wherein the first material and the second material are both a light diffusion glue.

9. The light string according to claim 4, wherein the light emitting device is an LED lamp provided thereinside with an integrated circuit chip.

10. The light string according to claim 9, wherein the third wire is electrically connected to a controller, and is configured to transmit an input control signal provided by the controller to the integrated circuit chip in each LED lamp.

11. A decorative lighting assembly, comprising a main body and at least one light string according to claim 9.

12. The light string according to claim 1, wherein the first wire, the second wire, and the third wire are in an integrated three-parallel-wire structure.

13. The light string according to claim 2, wherein the first wire, the second wire, and the third wire are in an integrated three-parallel-wire structure.

14. The light string according to claim 3, wherein the first wire, the second wire, and the third wire are in an integrated three-parallel-wire structure.

15. The light string according to claim 1, wherein the first wire, the second wire and the third wire are three independent wires.

16. The light string according to claim 2, wherein the first wire, the second wire and the third wire are three independent wires.

17. The light string according to claim 3, wherein the first wire, the second wire and the third wire are three independent wires.

18. The light string according to claim 2, wherein the light emitting device is an LED lamp provided thereinside with an integrated circuit chip.

19. The light string according to claim 3, wherein the light emitting device is an LED lamp provided thereinside with an integrated circuit chip.

* * * * *